US008973418B2

(12) United States Patent
Graham

(10) Patent No.: US 8,973,418 B2
(45) Date of Patent: Mar. 10, 2015

(54) MECHANICAL COMBINATION LOCK

(71) Applicant: Schlage Lock Company LLC, Indianapolis, IN (US)

(72) Inventor: Matthew S. Graham, Noblesville, IN (US)

(73) Assignee: Schlage Lock Company LLC, Indianapolis, IN (US)

( * ) Notice: Subject to any disclaimer, the term of this patent is extended or adjusted under 35 U.S.C. 154(b) by 72 days.

(21) Appl. No.: 13/890,092

(22) Filed: May 8, 2013

(65) Prior Publication Data

US 2013/0298620 A1 Nov. 14, 2013

Related U.S. Application Data

(60) Provisional application No. 61/644,380, filed on May 8, 2012.

(51) Int. Cl.

| | |
|---|---|
| ***E05B 15/12*** | (2006.01) |
| ***E05B 37/16*** | (2006.01) |
| ***E05B 37/00*** | (2006.01) |

(52) U.S. Cl.

CPC ..... *E05B 37/16* (2013.01); *E05B 37/00* (2013.01); *E05B 37/163* (2013.01); *E05B 37/0058* (2013.01); *E05B 37/166* (2013.01)

USPC ..... 70/322; 70/306; 70/288; 70/291; 70/302; 70/323

(58) Field of Classification Search

USPC ..... 70/288, 291, 292, 294, 301, 302, 303 A, 70/303 R, 305–308, 320–323

See application file for complete search history.

(56) References Cited

U.S. PATENT DOCUMENTS

| | | | | |
|---|---|---|---|---|
| 1,452,503 | A * | 4/1923 | Grubb | 70/306 |
| 3,040,556 | A | 6/1962 | Rosenhagen | |
| 3,115,765 | A | 12/1963 | Fengler | |
| 3,616,667 | A | 11/1971 | McGourty | |
| 3,832,873 | A | 9/1974 | Barnette | |
| 4,027,508 | A | 6/1977 | McGourty | |
| 4,111,017 | A | 9/1978 | Barnette | |
| 4,476,698 | A * | 10/1984 | Treslo | 70/25 |
| 4,708,006 | A | 11/1987 | Hodgson | |
| 4,732,020 | A | 3/1988 | Pieddeloup | |
| 4,827,743 | A | 5/1989 | Kim | |
| 4,848,116 | A | 7/1989 | Lizotte | |
| 6,000,254 | A | 12/1999 | Raybary | |
| 6,026,665 | A * | 2/2000 | Raybary | 70/214 |
| 6,434,981 | B2 | 8/2002 | Fantl et al. | |
| 6,575,004 | B2 | 6/2003 | Berton et al. | |
| 7,216,518 | B2 | 5/2007 | Shao | |
| 7,316,139 | B2 | 1/2008 | Nakazima et al. | |
| 7,581,417 | B1 | 9/2009 | Chen | |
| 7,934,405 | B2 | 5/2011 | Burmesch et al. | |
| 2011/0056251 | A1 | 3/2011 | Komiya | |
| 2011/0132049 | A1 | 6/2011 | Meekma et al. | |
| 2011/0239715 | A1 | 10/2011 | Weiershausen | |
| 2013/0298620 | A1 * | 11/2013 | Graham | 70/322 |

* cited by examiner

*Primary Examiner* — Suzanne Barrett
(74) *Attorney, Agent, or Firm* — Krieg DeVault LLP

(57) ABSTRACT

The present application includes a combination lock system having gears, cams, and an interference system. In one embodiment, the angular position of the cams is adjusted by a user interface through operation of the gears. When the cams are in a predetermined position, the interference system is movable with respect to the cams and the system is unlocked. The user interface may be a pushbutton keypad.

25 Claims, 12 Drawing Sheets

MECHANICAL COMBINATION LOCK

CROSS REFERENCE TO RELATED APPLICATIONS

The present application claims the benefit of U.S. Provisional Patent Application 61/644,380, filed May 8, 2012, which is incorporated herein by reference.

TECHNICAL FIELD

The present invention generally relates to mechanical combination locks, and more particularly, but not exclusively, to mechanical permutation locks.

BACKGROUND

Conventional mechanical combination locks suffer from a variety of limitations and disadvantages. For example, many conventional mechanical keypad locks can distinguish either multiple presses of a single button, or the sequence in which the buttons were pressed, but not both. Accordingly, there remains a need for further contributions in this area of technology.

SUMMARY

One embodiment of the present invention is a unique mechanical combination lock. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
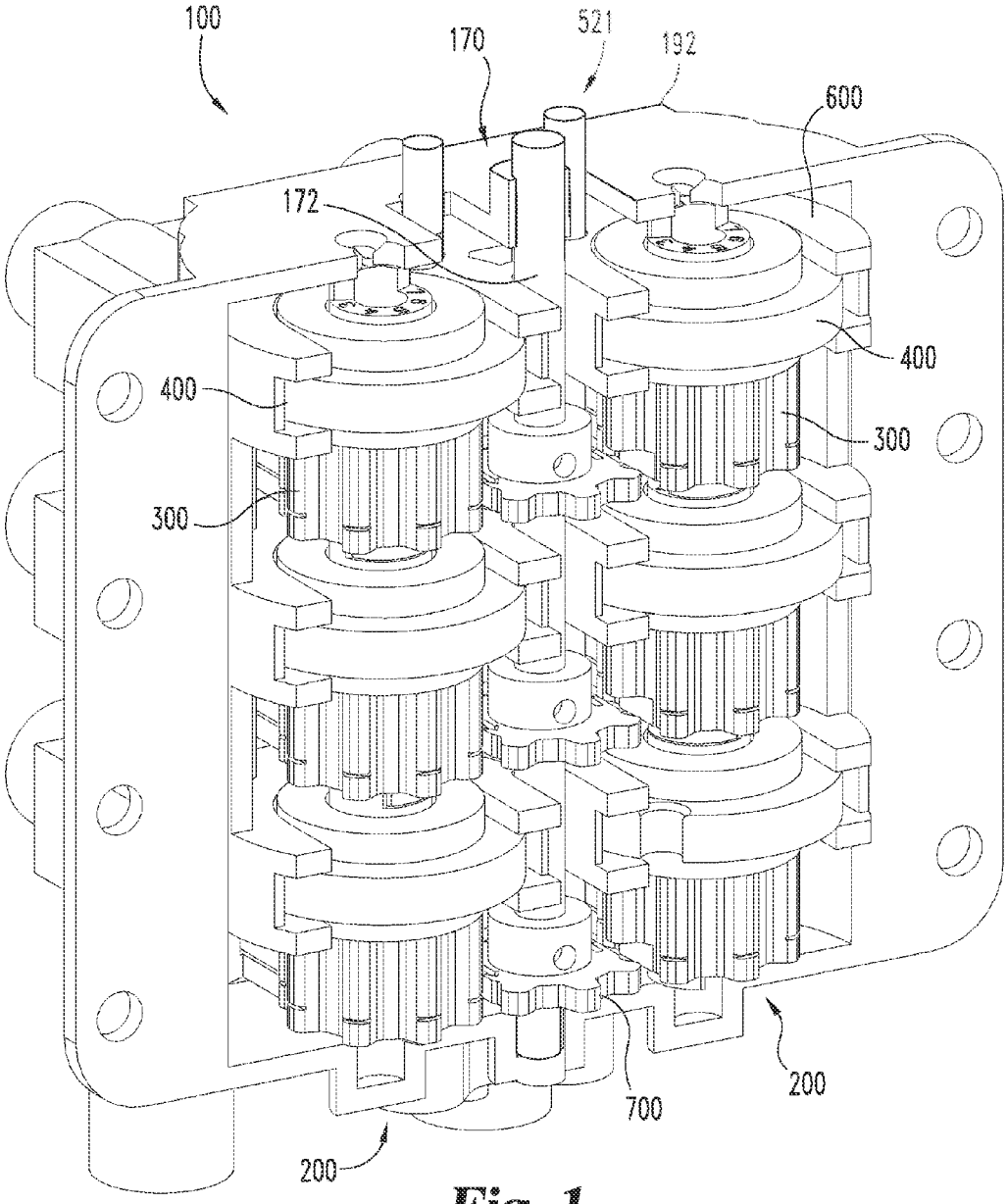
FIG. 1 is an illustration of a locking system according to a first embodiment of the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrates an exemplary locking system 100. System 100 can be employed in any fashion known in the art, such as, for example, as a door lock, bike lock, or padlock. System 100 includes a housing 192, which houses a reset device 170, columns 200, a carriage 600, and a fence (not labeled in FIG. 1). Each column 200 comprises a plurality of gear units 300 and cams 400. Each unit 300 is coaxially associated with a cam 400, defining a unit-cam pair. In the illustrated embodiment, system 100 includes two columns 200, each having three units 300 and three cams 400. It is also contemplated that system 100 may include any number of columns 200, each column 200 including at least two unit-cam pairs. In some embodiments, the teeth of units 300 can engage a detent mechanism that captures the unit after each input and resists movement of the unit until the next input. The detent may be spring-biased.

Figure 2:
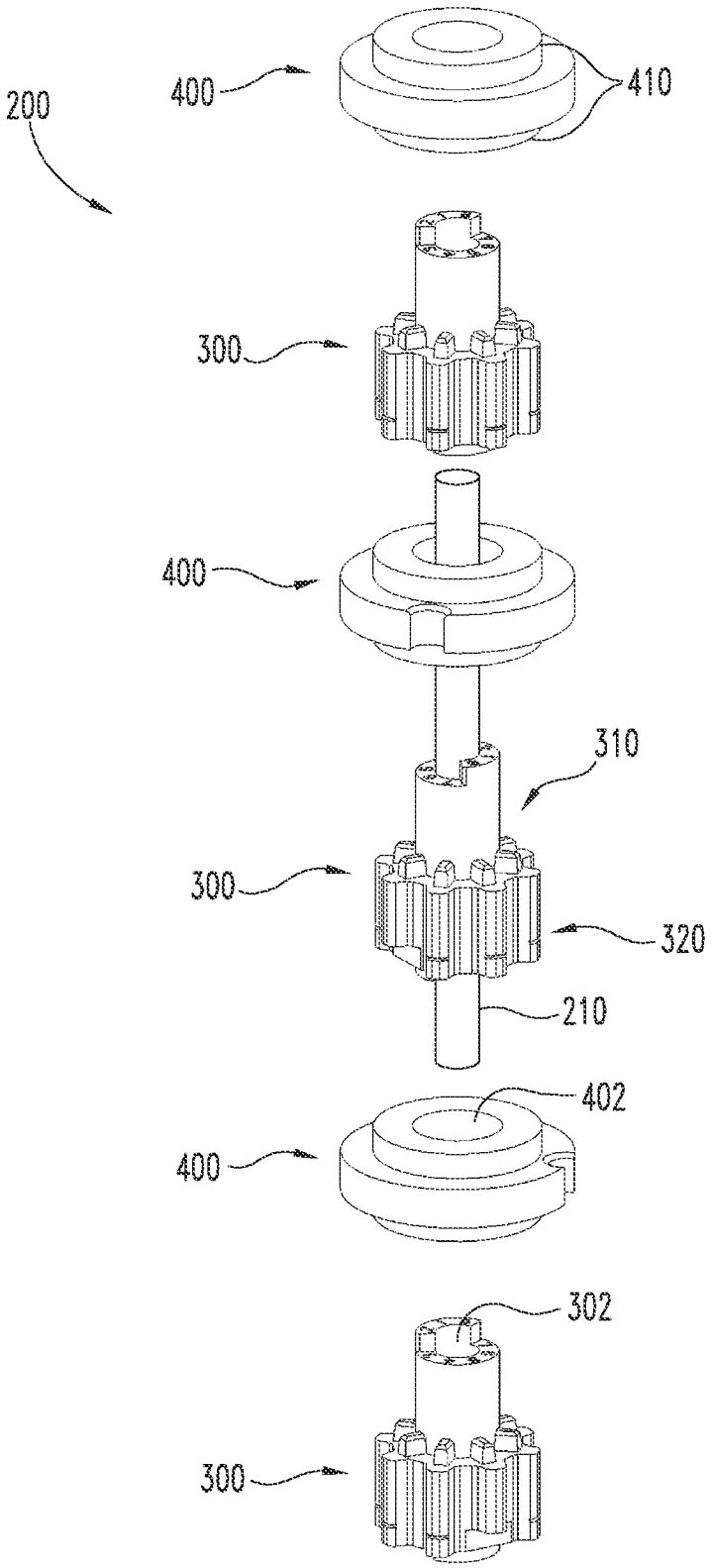
FIG. 2 is an exploded view of the locking column illustrated in FIG. 1.

FIG. 2 is an exploded view of column 200 having units 300 and cams 400. Each unit 300 has a top portion 310, a bottom portion 320, and an axial passage 302. As used herein, the axial direction of columns 200 define the vertical direction (as well as related terms such as top/bottom and upper/lower), such that columns 200 rotate about a horizontal plane. These terms are used for ease of convenience and description, and are without regard to the orientation of system 100 with respect to the environment. For example, descriptions that reference a vertical direction is equally applicable when the system is in a horizontal orientation or off-axis orientation. Therefore the terms are not to be construed as limiting the scope of the subject matter herein.

Axial passages 302 are configured to receive an axle 210 such that each cam 400 is rotatable with respect to axle 210. Each cam 400 has an axial passage 402 configured to receive top portion 310. In column 200, each cam 400 is coaxially associated with a unit 300. Top portion 310 is positioned at least partially in an axial passage 402, thus forming a unit-cam pair, and axle 210 passes through each axial passage 302.

Figure 3:
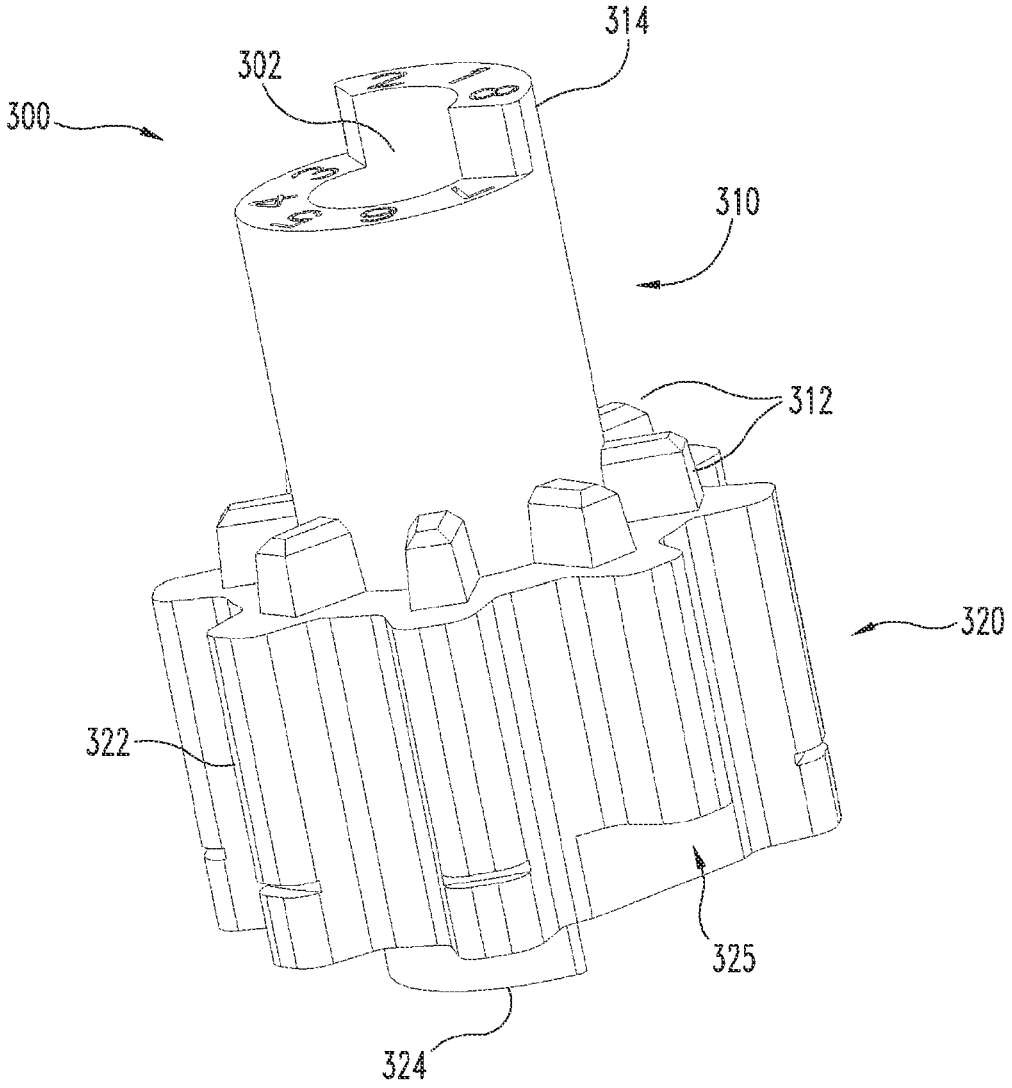
FIG. 3 is a perspective view of a gearing unit used in the column of FIG. 2

With reference now to FIG. 3, an illustrative unit 300 includes an axial passage 302, a top portion 310, and a bottom portion 320. Bottom portion 320 defines a plurality of teeth 322, the centerline of each tooth being offset from the centerline of each adjacent tooth by a tooth angle. In certain embodiments, a unit is operable between a plurality of incremental angular positions. In such embodiments, the number of incremental positions may be equal to the number of teeth. Each incremental position is offset from the previous incremental position by an increment angle which is defined as the tooth angle. For example, in system 100, each unit 300 is operable between eight incremental positions P1-P8, each incremental position being offset from the previous by 45°. For example, at position P4, each tooth 322 occupies a space which is occupied by an adjacent tooth in either the adjacent incremental position P3 or the adjacent incremental position P5.

Clockwise rotation generally increases the position number (which may be abbreviated as P+), and counter-clockwise rotation generally decreases position number (which may be abbreviated as P−). It is of course understood that "increasing" and "decreasing" the position number includes the transition between the first position and the last position. That is to say, in the illustrated embodiment, an incremental increase from position 8 results in position 1, and an incremental decrease from position 1 results in position 8.

In the illustrated embodiment, unit 300 has eight teeth, such that the tooth angle is 45°. In other embodiments, a unit may include more or fewer teeth. One of teeth 322 includes a missing portion, shown in FIG. 3 as blank 325. In the illustrated embodiment, blank 325 is positioned at the lower end of bottom portion 320, though in other embodiments, blank 325 may be positioned at another location. The function of blank 325 is described below with respect to FIG. 7.

Top portion 310 is a hollow generally cylindrical body, and includes protrusions 312. In the illustrated embodiment, the number of protrusions 312 is the same as the number of teeth 322, and the centerline of each protrusion is offset from the centerline of each adjacent protrusion by the increment angle. In other embodiments, fewer protrusions may be used, such that the centerline of each protrusion is offset from the centerline of each adjacent protrusion by an integer multiple of the increment angle. Other configurations are also contemplated.

Top portion 310 defines top fly 314, and bottom portion 320 defines bottom fly 324. Top fly 314 is defined by a first arcuate segment of top portion 310 having an axial length greater than that of a second arcuate segment of the top portion 310. Bottom fly 324 is substantially similar to top fly 314, and is formed on bottom portion 320. In the illustrated embodiment, flies 314, 324 each span three increments, or about 135°, and are positioned on opposite sides of the passage 302. It is also contemplated that flies 314, 324 may be positioned at other locations, and may be of different configurations, as will be described below.

Figure 4:
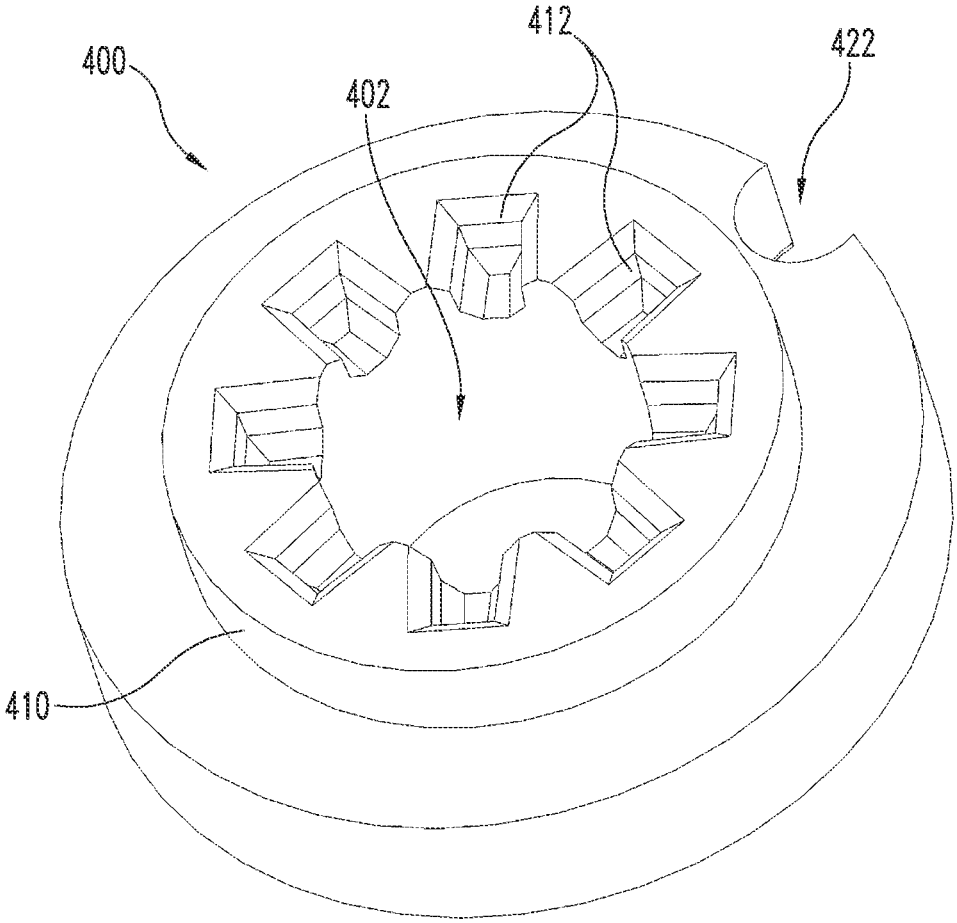
FIG. 4 is a perspective view of a cam used in the column of FIG. 2.

With reference now to FIG. 4, an illustrative cam 400 includes an axial passage 402 and a notch 422. Axial protrusions 410 protrude from opposing sides of cam 400, and are sized such that when cam 400 is positioned between two units 300 as shown in FIG. 1, the top fly 314 of the lower unit 300 is selectively engageable with the bottom fly 324 of the upper unit 300. An example of the selective engagability of the flies is described below with reference to FIG. 9.

One of axial protrusions 410 has formed therein a plurality of recesses 412, each configured to receive a protrusion 312. In certain embodiments, axial protrusions 410 may not be positioned on cam 400, and recesses 412 may be formed in the cam. The number of recesses 412 corresponds to the number of incremental positions, and a centerline of each recess 412 is offset from the centerlines of adjacent recesses by the incremental angle, although other configurations are also contemplated. When protrusions 312 are positioned in recesses 412, cam 400 is rotationally coupled to unit 300. When protrusions 312 are not positioned in recesses 412, cam 400 is rotatable with respect to unit 300.

Figure 5:
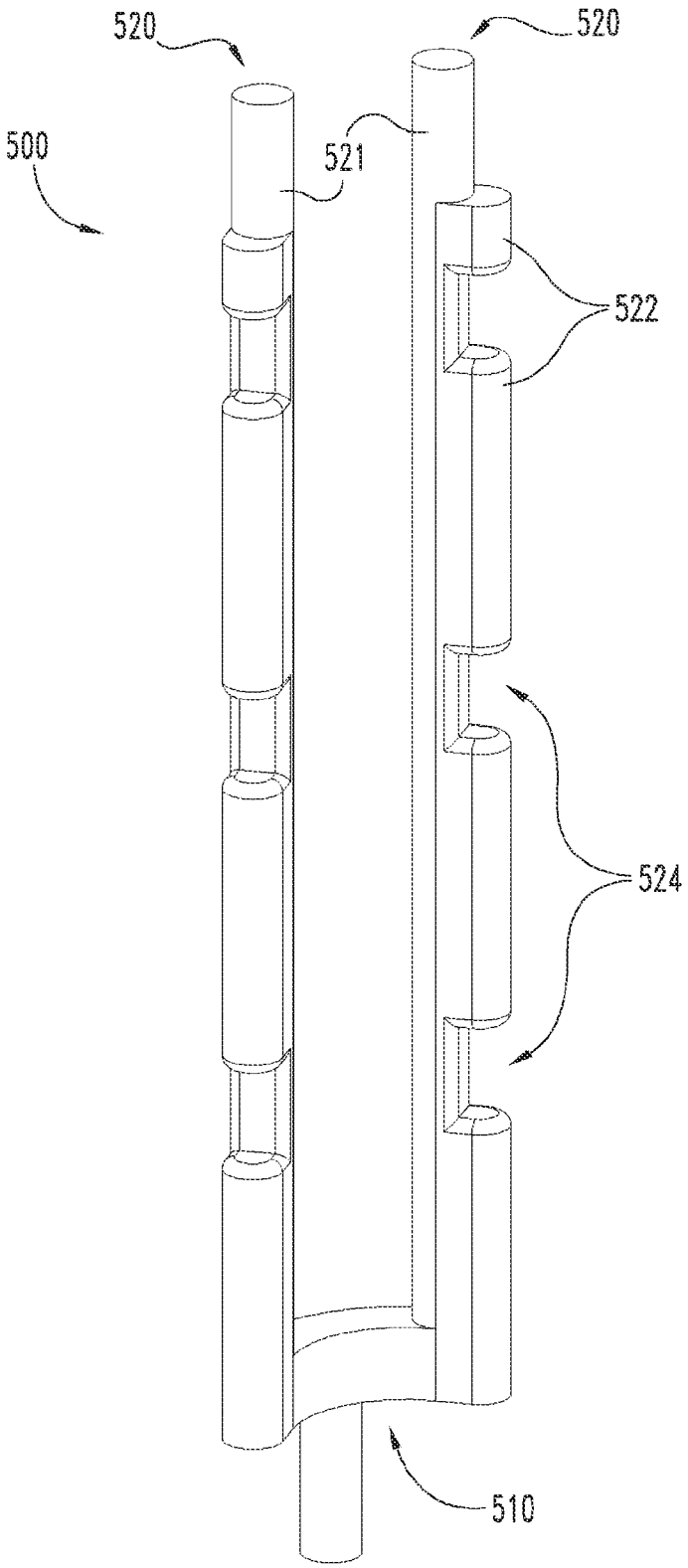
FIG. 5 illustrates an example interference device.

With reference to FIG. 5, an illustrative fence 500 includes two prongs 520 coupled by a connecting portion 510. Each prong 520 defines a plurality of protrusions 522 and recesses 524. Protrusions 522 are configured to be received in a notch 422, and recesses 524 are configured to receive a cam 400. When all protrusions aligned with a notch, the fence is movable with respect to housing 192. When the notch of at least one cam is not so aligned, fence 500 is not movable with respect to the housing. This interface of the notches with the locking fence provides a level of security that is not easily bypassed using non-invasive methods such as magnetic attraction or vibration.

In the illustrated embodiment, fence 500 is a vertically movable fence, configured to be movable in the vertical direction of columns 200 when all notches 422 are aligned with protrusions 522. In other embodiments, a fence may be a radially movable fence, operable to move in the radial direction of cams 400 when all notches 422 are aligned with protrusions 522. A horizontal fence may or may not include recesses 524.

Fence 500 also includes interference portions, here illustrated as rods 521. The interference portions are configured to engage any locking system known in the art. In an unlocked formation of columns 200, the interference portions are movable with respect to housing 192, such that a user is able to lock or unlock the locking system. In the illustrated embodiment, fence 500 includes two prongs 520 and two rods 521, corresponding to the two columns 200. In embodiments which include a different number of columns 200, fence 500 may include a corresponding number of prongs 520.

Figure 6:
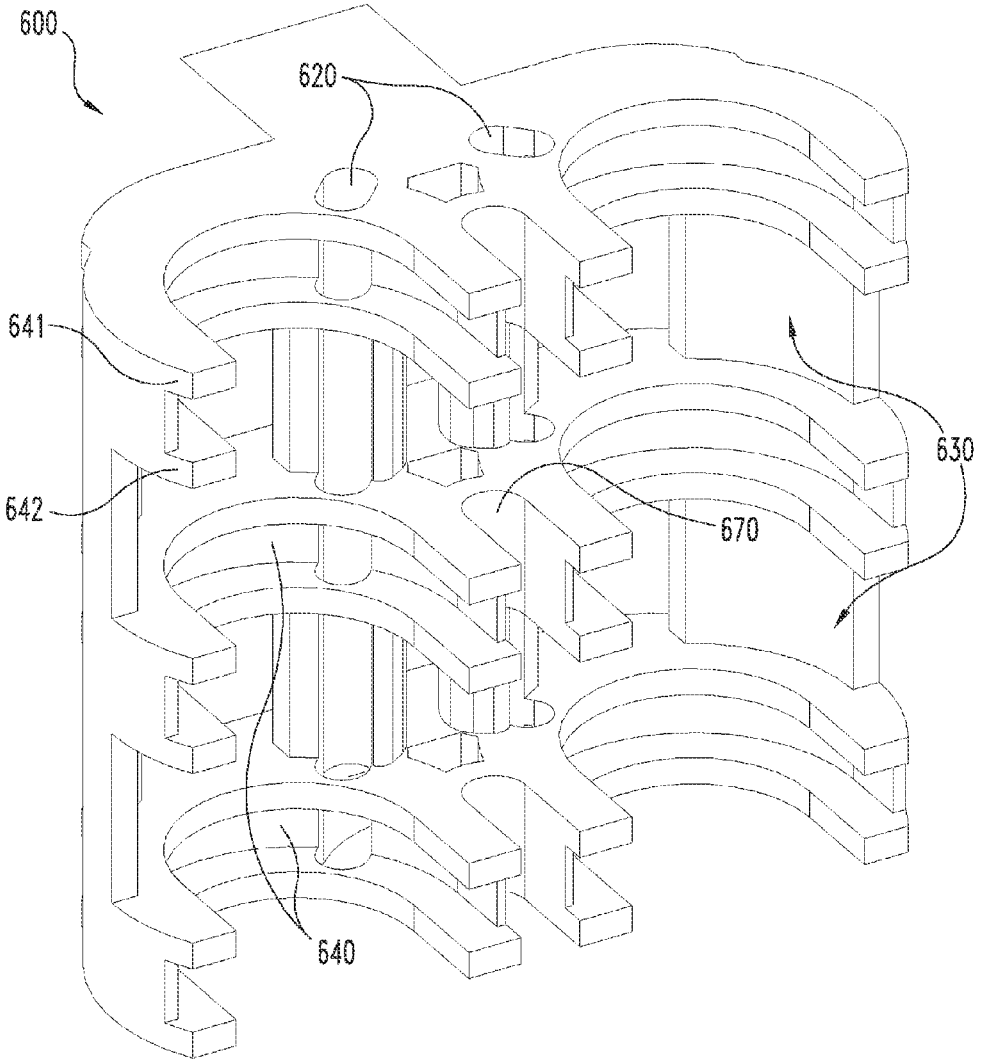
FIG. 6 is a perspective view of a carriage.

With reference now to FIG. 6, an illustrative carriage 600 includes fence channels 620, cavities 630, seats 640, and reset channels 670. Each fence channel 620 is configured to receive a prong 520 of fence 500, such that fence 500 is substantially restricted to movement in a vertical direction. In embodiments which utilize a radially movable fence, fence channels 620 may be instead configured to restrict such a fence to movement in the radial direction.

Cavities 630 and seats 640 are each defined by upper walls 641 and lower walls 642. Cavities 630 are configured to receive units 300, and seats 640 are configured to receive cams 400. Walls 641, 642 are positioned on carriage 600 such that cavities 630 have a height which is greater than the combined height of teeth 322 and protrusions 312, and such that seats 640 have a height that is greater than the height of cam 400.

Each seat 640 is configured to receive a cam 400, such that cam 400 is at least partially positioned between an upper wall 641 and a lower wall 642. Walls 641, 642 include arcuate segments configured to receive axial protrusions 410 extending from axial sides of cam 400. In the illustrated embodiment, walls 641, 642 are each contiguous and arcuate, such that seat 640 is a single contiguous channel. In other embodiments, walls 641, 643 could be replaced by one or more protrusions, in which case seat 640 would be defined as a volume between a plane defined by one side of the cam and a plane defined by another side of the cam.

Figure 7:
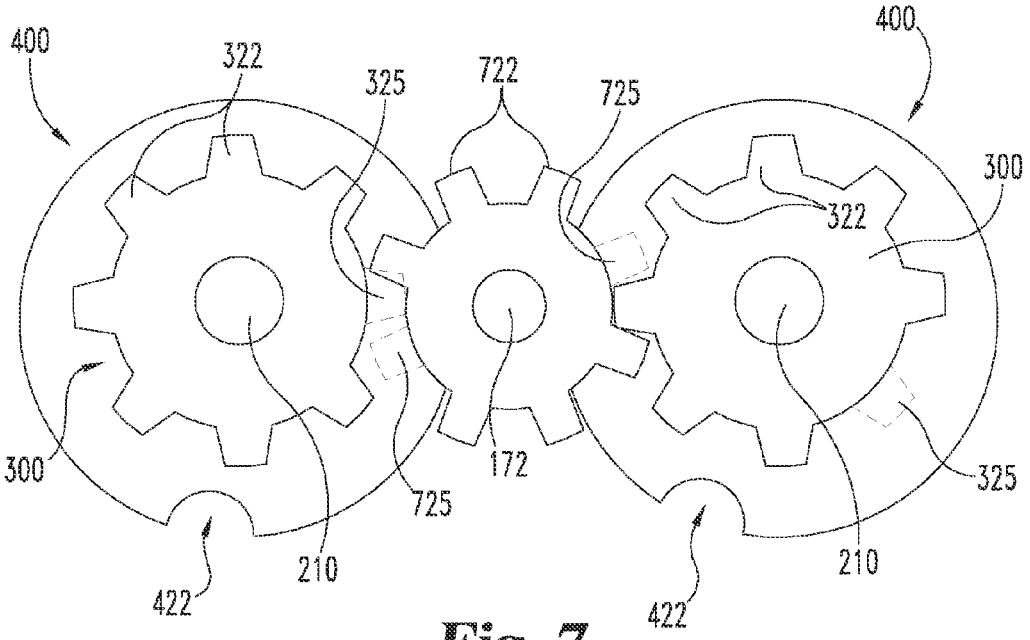
FIG. 7 is a schematic illustration of a reset mechanism.

Reset channel 670 is configured to receive rod 172 of reset mechanism 170. As previously noted, reset mechanism 170 includes a plurality of reset gears 700 corresponding to the plurality of units 300, the operation of which will now be described. With reference to FIG. 7, as well as reference to FIG. 1, an example reset gear 700 is fixedly coupled to reset rod 172. Reset gear 700 includes toothed portions defining teeth 722, and untoothed portions, defined as portions having missing teeth 725.

Reset gear 700 is positioned between units 300 which occupy the same horizontal plane such that each unit 300 can be engaged by reset gear 700 in a first set of incremental positions of the unit, and cannot be engaged by reset gear 700 in a second set of incremental positions of the unit. In the illustrated embodiment, each unit 300 can be engaged by reset gear 700 across seven incremental positions of the unit, and is not engaged by reset gear 700 in a single incremental position of the unit. The incremental position of each unit 300 in which it cannot be engaged by reset gear 700 is the home position of the unit, and is determined by the position of blank 325. That is to say, when a unit 300 is not in a home position, teeth 722 engage teeth 322, and when a unit is in a home position, teeth 722 pass through blanks 325.

To reset each unit 300 to its respective home position, a user engages a rotating mechanism (not shown) configured to rotate rod 172. Rotation of rod 172 also rotates each reset gear 700, which in turn engages each unit 300 which is not in a home position. The rotating mechanism may be a knob, lever, wheel, or any other device configured to impart rotation. Once a sufficient number of rotations have been performed by reset gears 700, each unit 300 is in a home position. At this point, each reset gear is rotated to a reset home position, defined as a position in which missing tooth 725 is aligned with blank 325, such that units 300 cannot engage reset gears 700.

In certain embodiments, reset gears 700 may be rotated to a reset home position manually by the user. For example, the rotating mechanism may have a first indicator which, when aligned with a second indicator, indicates that each reset gear 700 is in a reset home position. In other embodiments, reset gears 700 may be rotated to their home position automatically by the configuration of the rotating mechanism or another component of system 100. For example, the rotating mechanism may bias reset gears toward the home position, such that once the rotating mechanism is not being operated by the user, the reset gears return to the home position. In certain embodiments, this may be achieved by a rotating mechanism having a lever operable across an angular range, and a gearing system configured translate the rotation of the lever across the angular range to a predetermined number of rotations of reset gears 700. The lever may be biased to a lever home position, such that once a force is no longer being applied, the lever returns to the lever home position, which in turn returns reset gears 700 to a reset home position.

Figure 8:
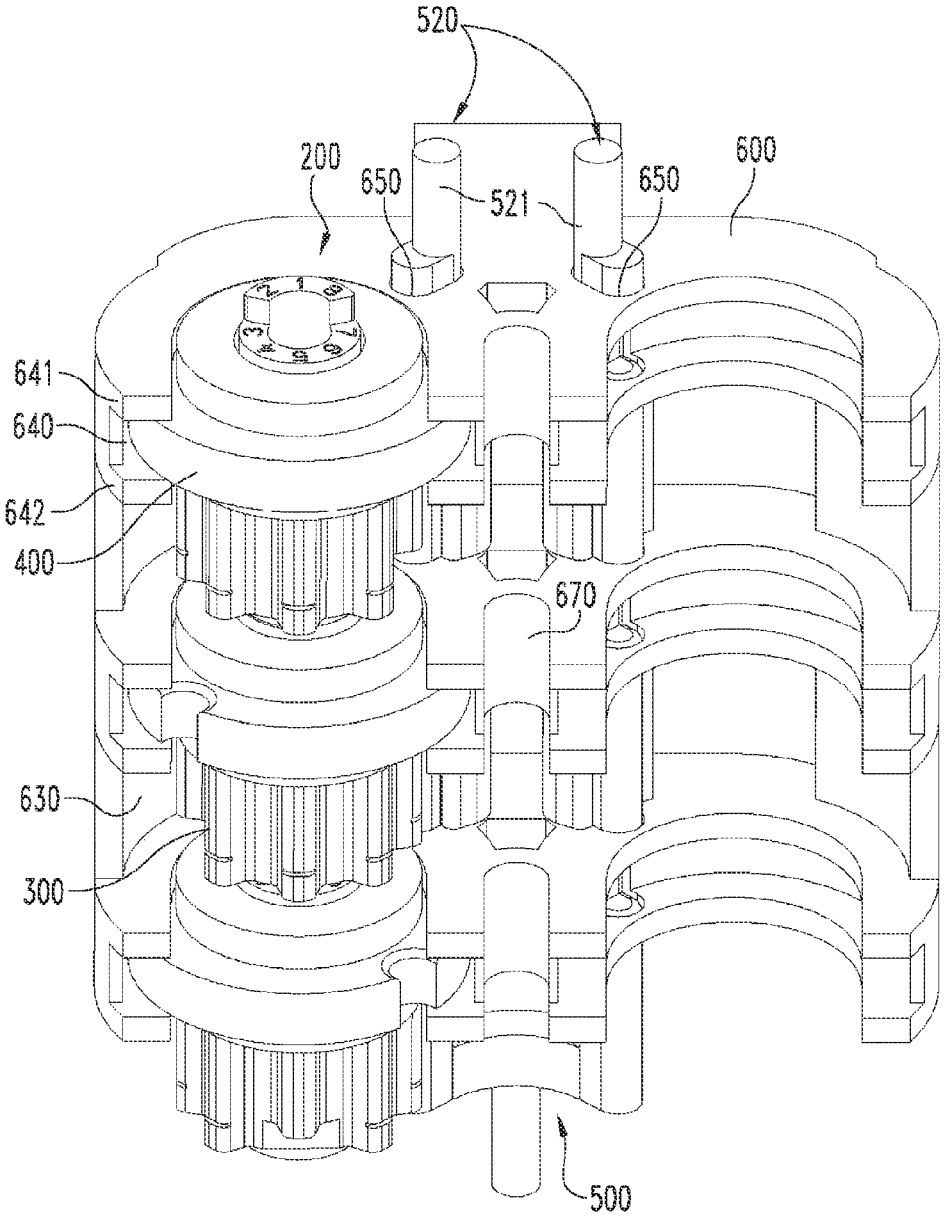
FIG. 8 is an illustration of a subassembly of the system of FIG. 1.

FIG. 8 illustrates a subassembly of system 100, including a column 200, fence 500, and carriage 600. Each prong 520 of fence 500 is inserted into a corresponding channel 650 such that rods 521 protrude vertically beyond a top surface of carriage 600, and may also protrude from housing 192 (as can be seen in FIG. 1). Fence 500 is positioned such that recesses 524 are substantially aligned with seats 640. Column 200 is positioned in carriage 600, such that units 300 and cams 400 are coaxially aligned, and such that each cam 400 is positioned in a seat 640.

In a locked formation of column 200 wherein at least one notch 422 is not aligned with protrusions 522, cam 400 prevents movement of fence 500 with respect to column 200. In an unlocked formation of column 200, wherein each notch 422 is aligned with protrusions 524, fence 500 is movable with respect to column 200, such that rods 521 can be removed from the disengaged from the corresponding locking system. In the unlocked formation, carriage 600 is also movable in the axial direction of columns 200. A lifting mechanism (not shown) may have a first portion coupled to carriage 600, and a second portion outside housing 192. Operating the lifting mechanism moves carriage 600 in the axial direction of columns 200. This in turn moves protrusions 522 into notches 422, and separates each cam 400 from its respective unit 300. The separation distance is greater than the height of protrusions 312, such that protrusions 312 are no longer positioned in recesses 412, and unit 300 is rotatable with respect to cam 400.

Figure 9:
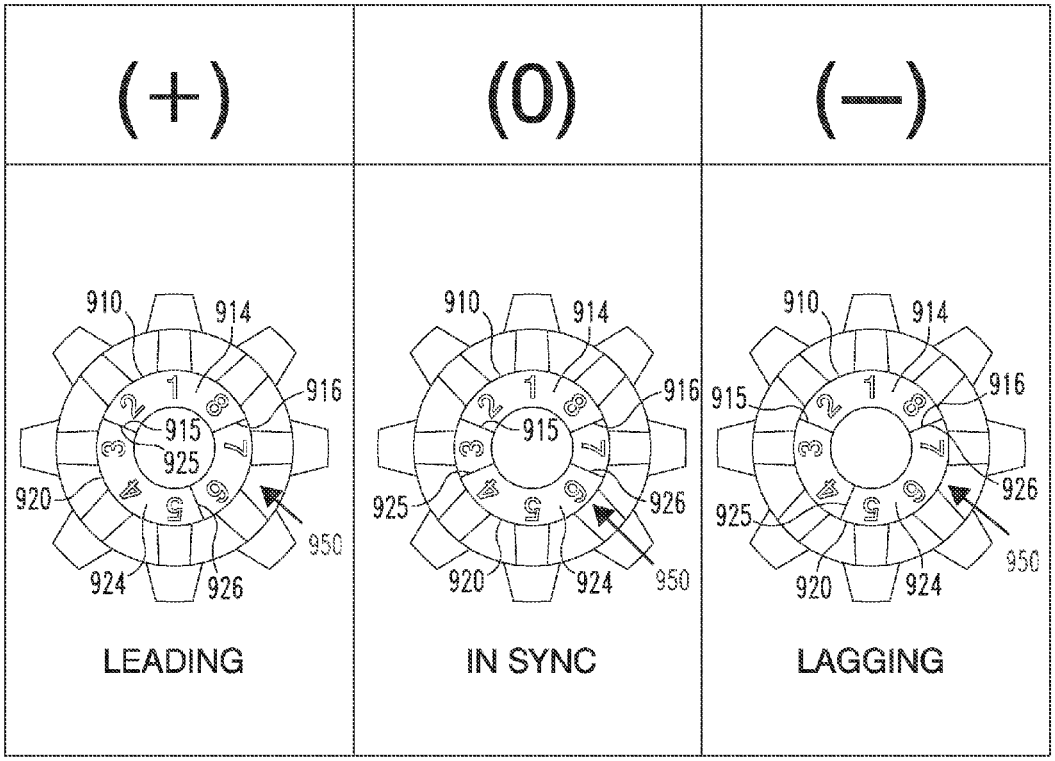
FIG. 9 illustrates various interface states of example units.

With reference to FIG. 9, an example of selective engagement between units such as units 300 will now be described. Bottom unit 910 coaxial with and positioned below top unit 920, such that the top fly 914 of bottom unit 910 selectively engages the bottom fly 924 of upper unit 920 at a fly interface 950. Fly 914 includes engagement surfaces 915, 916; fly 924 includes engagement surfaces 925, 926.

In the illustrated embodiment, there are eight incremental positions of units 910, 920, and each fly 914, 924 has an angular span of three increments such that there is a two-increment play between fly 914 and fly 924. As a result, units 910 and 920 are free to rotate with respect to one another across a free-rotation angle corresponding to two increments.

FIG. 9 illustrates three states of fly interface 950, including a leading state (+), an in sync state (0), and a lagging state (−). In the illustrated embodiment, the play is two increments, such that interface 950 is operable between three states (+), (0), (−). It is also contemplated that the play may be only one increment such that the units are operable between two states, or the play may be three or more increments such that the units are operable between four or more states.

In leading state (+), top unit 920 leads bottom unit 910 by one increment. For example, if bottom unit 910 is in position P5, top unit is in position P6. In leading state (+), surface 915 of fly 914 is in contact with surface 925 of fly 924. Thus, a one-increment counter-clockwise rotation of bottom unit 910 or a one-increment clockwise rotation of top unit 920 also causes a one-increment position change of the other unit. That is to say that in leading state (+), P+ of top unit 920 results in P+ of bottom unit 910, and P− of bottom unit 910 results in P− of top unit 920. A one-increment counter-clockwise rotation of top unit 920 or a one-increment clockwise rotation of bottom unit 910 results in a one-increment decrease in the state (which may be abbreviated as S−) of fly interface 950 to in sync state (0). That is to say that in leading state (+), P− of top unit 920 (or P+ of bottom unit 910) results in S− of fly interface 950.

In lagging state (−), top unit 920 lags bottom unit 910 by one increment. For example, if bottom unit 910 is in position P5, top unit 920 is in position P4. In lagging state (−), surface 916 of fly 914 is in contact with surface 926 of fly 924. Thus, a one-increment clockwise rotation of bottom unit 910 or a one-increment counter-clockwise rotation of top unit 920 also causes a one-increment position change of the other unit. That is to say that in lagging state (−), P− of top unit 920 results in P− of bottom unit 910, and P+ of bottom unit 910 results in P+ of top unit 920. A one-increment clockwise rotation of top unit 920 or a one-increment counter-clockwise rotation of bottom unit 910 results in a one-increment increase in the state (which may be abbreviated as S+) of fly interface 950 to in sync state (0). That is to say that in lagging state (−), P+ of top unit 920 (or P− of bottom unit 910) results in S+ of fly interface 950.

In in sync state (0) top unit 920 is in sync with bottom unit 910. For example, if bottom unit 910 is in position P5, top unit 920 is also in position P5. In in sync state (0), neither surface 915, 916 of fly 914 is in contact with the corresponding surface 925, 926 of fly 924. A one-increment rotation in either direction of one unit 910, 920 results in a change in the state of fly interface 950, but does not cause the other unit 910, 920 to rotate. The change in state corresponds to the direction of relative rotation of top fly 920 with respect to bottom fly 910. That is to say that in in sync state (0), P+ of top unit 920 (or P− of bottom unit 910) results in S+ of fly interface 950 to leading state (+), and P− of top unit 920 (or P+ of bottom unit 910) results in S− of fly interface 950 to lagging state (−).

Figure 10A:
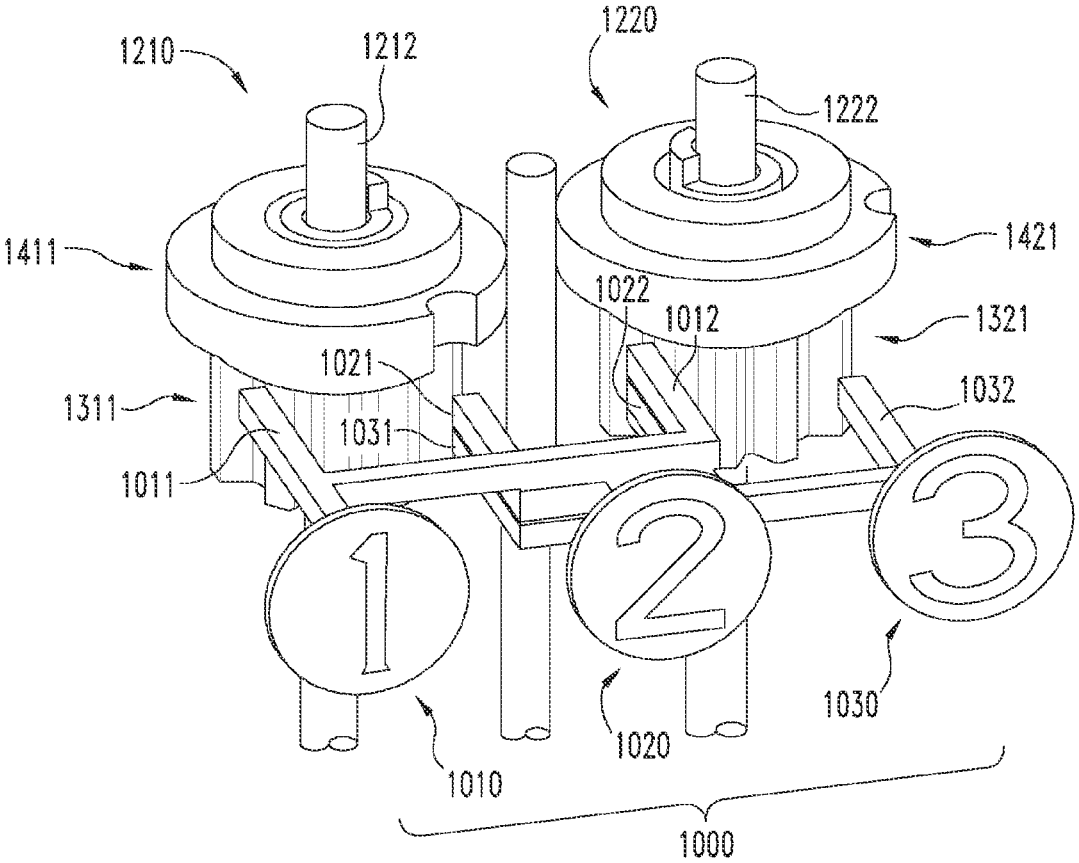
FIG. 10*a* is an illustration of an example code input system.
Figure 10B:
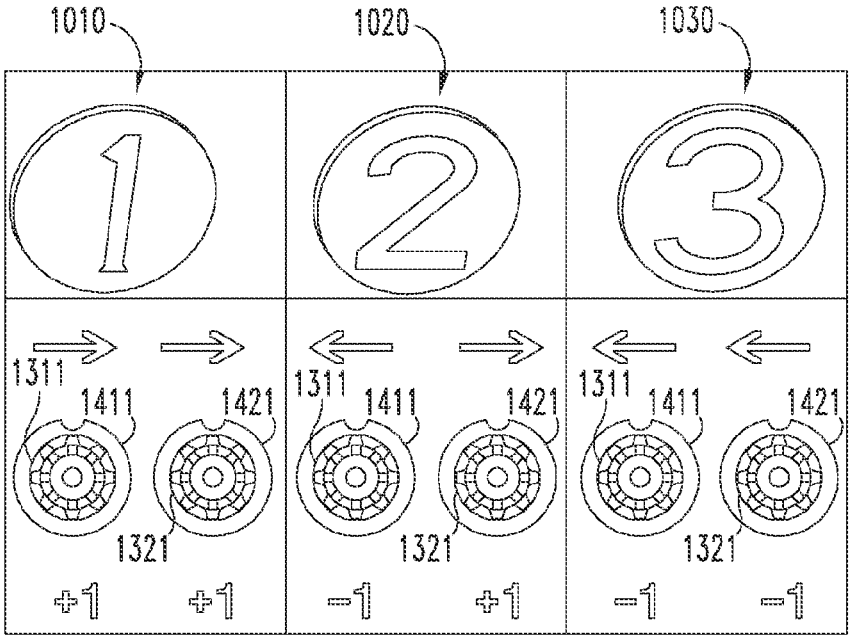
FIG. 10*b* illustrates positional changes caused by the code input system of FIG. 10*a*.

FIGS. 10*a* and 10*b* illustrate an example input system 1000 for causing rotation of units 300. Input system 1000 includes a plurality of push-buttons 1010, 1020, 1030, each operable to rotate units 1311, 1321. Each push-button 1010, 1020, 1030 is independently slidingly mounted—for example through a hole formed in a faceplate—such that it can be forced into contact with a tooth of each unit 1311, 1321, thereby rotating at least one unit by one increment.

Each pushbutton includes a first leg operable to engage a tooth of unit 1311 and a second leg operable to engage a tooth of unit 1321. For example, pushbutton 1010 has a first leg 1011 operable to engage a tooth on the left side of gear 1311 and a second leg 1012 operable to engage a tooth on the left side of gear 1321. Each pushbutton is operable between a home position and a thrown position, the positions being separated by a throwing distance. The throwing distance is such that operating the pushbutton rotates the corresponding units by an angle corresponding to one increment. Each pushbutton 1010, 1020, 1030 is provided with a biasing member configured to urge the pushbutton from the thrown position to the home position.

When pushbutton 1010 is forced into the thrown position, legs 1011, 1012 force the teeth in the throwing direction, thereby rotating units 1311, 1321. Pushbutton 1010 is thus configured to rotate units 1311, 1321 by one increment in a clockwise direction. That is to say, pushing pushbutton 1010 causes P+ of units 1311, 1321. When pushbutton 1010 is no longer being pushed inward, a biasing member (not shown) urges pushbutton 1010 outward to home position. Pushbuttons 1020 and 1030 operate in a similar manner, with the exception of the directions in which they are operable to rotate units 1311, 1321.

Pushbutton 1020 is operable to engage a tooth on the right side of unit 1311 and a tooth on the left side of unit 1321, such that pushing pushbutton 1020 rotates unit 1311 by one increment in a counter-clockwise direction and unit 1321 by one increment in a clockwise direction. That is to say, pushing pushbutton 1020 causes P− of unit 1311, and P+ of unit 1321. Pushbutton 1030 is operable to engage a tooth on the right side of unit 1311 and a tooth on the right side of unit 1321, such that pushing pushbutton 1030 rotates units 1311, 1321 by one increment in a counter-clockwise direction. That is to say, pushing pushbutton 1030 causes P− of units 1311, 1321.

In the illustrated embodiment, input system 1000 includes three pushbuttons, each configured to rotate both units 1311, 1321. It is also contemplated that an input system may include additional, fewer, or alternative pushbuttons, which may be configured to operate one or more unit. For example, in a locking system having three columns, a pushbutton may be operable to rotate a unit in only one column, a pushbutton may be operable to rotate a unit in the outer columns, and a pushbutton may be configured to rotate a unit in each column.

While input system 1000 is shown as comprising a plurality of pushbuttons, certain embodiments utilize different input systems. For example, the input system could include one or more of sliders, levers, dials, knobs, joysticks or any other input system capable of adjusting the angular position of one or more unit.

Figure 11:
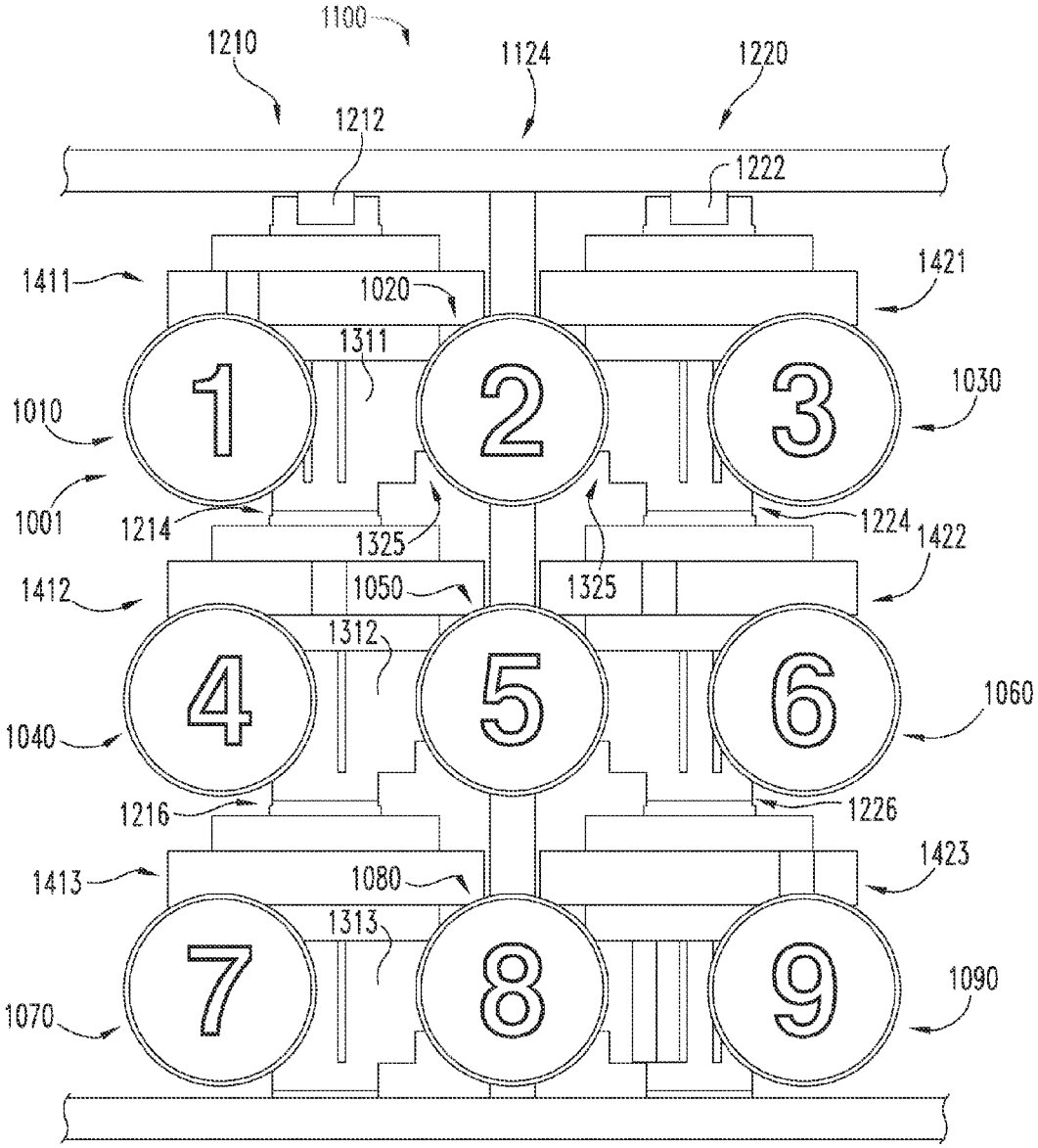
FIG. 11 is an illustration of a locking system with an example input system according to a second embodiment of the invention.

FIG. 11 illustrates an example locking system 1100 having a reset mechanism 1124, two columns 1210, 1220, a pushbutton input system 1001. Reset mechanism 1124 includes reset gears (not shown) similar to reset gear 700. In the illustrated embodiment, a single reset gear is operable to reset both units in the row. For example, a single reset gear is operable to reset units 1311, 1321. In other embodiments, one or more reset gear may be operable to reset a single unit. Reset mechanism 1124 is operable to set each column 1210, 1220 to a home position in which the missing tooth portions 1325 are axially aligned.

Each column 1210, 1220 includes three rows of unit-cam pairs. That is to say, column 1210 is rotatably mounted on an axle 1212 and includes units 1311, 1312, 1313 and cams 1411, 1412, 1413; column 1220 is rotatably mounted on an axle 1222 and includes units 1321, 1322, 1323 and cams 1421, 1422, 1423. A plurality of fly interfaces define a location at which the bottom fly of an upper unit is selectively engageable with the top fly of a lower unit. For example, the bottom fly of unit 1311 is selectively engageable with the top fly of unit 1312 at fly interface 1214.

In operation of system 1100, each column 1210, 1220 is operable between a plurality of formations. The number of formations is a function of the number of unit-cam pairs in the column, the number of incremental positions of each unit, and the number of states of each fly interface. In the illustrated embodiment, these factors correspond to the number of rows, the number of gear teeth, and the amount of play available between adjacent units. In column 1210, unit 1311 is operable between eight incremental positions, and fly interfaces 1214, 1216 are each operable between three states. As in the above-described embodiments, unit 1311 is operable between incremental positions P1-P8, and the fly interfaces 1214, 1216 are operable between leading state (+), in sync state (0), and lagging state (−). A formation of column 1210 can thus be succinctly described as (position of unit 1311/state of fly interface 1214/state of fly interface 1216), for example (1/+/+).

Columns 1210, 1220 are shown after having been reset to a home formation by reset mechanism 1124. Missing tooth portions 1325 are positioned on each unit such that, in the home position of a column, the topmost unit is at a predetermined position, and either each fly interface is in leading state (+), or each fly interface is in lagging state (−). The home formation of column 1210 is defined as formation (1/+/+), wherein unit 1311 is at incremental position 1, and fly interfaces 1214, 1216 are each in leading state (+). The home formation of column 1220 is defined as formation (1/−/−), wherein unit 1321 is at incremental position 1, and fly interfaces 1224, 1226 are each in lagging state (−). While the home formation of system 1100 is system formation (1/+/+) (1/−/−), it is also contemplated that in other embodiments, the system home formation may be different. The home formation is defined by the relative positions of the blanks 1325.

Input system 1001 comprises three rows, each of which is a substantial duplicate of input system 1000. Although not shown in FIG. 11, each pushbutton includes two legs configured similarly to the legs of the corresponding pushbutton of input system 1000. That is to say, pushbuttons 1040, 1070 are substantially similar to pushbutton 1010; pushbuttons 1050, 1080 are substantially similar to pushbutton 1020; pushbuttons 1060, 1090 are substantially similar to pushbutton 1030.

In the illustrated embodiment, locking system 1100 includes two columns 1210, 1220, each having three rows of unit-cam pairs. In certain embodiments, a locking system may have as few as one column of two rows. In other embodiments, a locking system includes at least two columns and at least two rows. In some embodiments, not all columns include the same number of rows.

With respect to FIGS. 11, 12*a*, and 12*b*, the operation of system 1100 during code entry will now be described. Each of FIGS. 12*a* and 12*b* illustrate from left to right: the home formations of columns 1210, 1220; changes to the formations caused by a first pushbutton press; the formations of columns 1210, 1220 after the first pushbutton press; changes to the formations caused by a second pushbutton press; the formations of columns 1210, 1220 after the second pushbutton press.

Figure 12A:
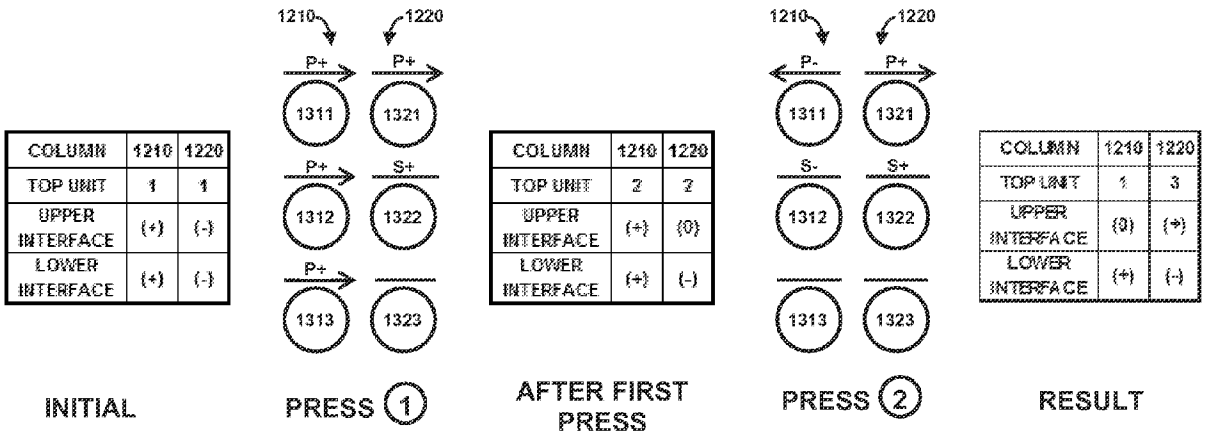
FIG. 12*a* illustrates the operation of the locking system FIG. 11 during entry of a first code.

In FIG. 12*a*, column 1210 begins in home formation (1/+/+), and column 1220 begins in home formation (1/−/−). The code to be entered in FIG. 12*a* is a first code "1-2". The first digit of the first code is entered by pressing pushbutton 1010. As described above, pressing pushbutton 1010 rotates units 1311, 1321 one increment in the clockwise direction such that the position of each unit 1311, 1321 is increased from P1 to P2. Fly interfaces 1214, 1216 each begin in leading state (+), and P+ of unit 1311 therefore causes P+ of units 1312, 1313. Fly interfaces 1224, 1226 each begin in lagging state (−), and P+ of unit 1321 therefore causes S+ of fly interface 1224. After the first pushbutton press, the system formation is (2/+/+) (2/0/−).

After pushbutton 1010 has been pressed, the second digit of the first code is entered by pressing pushbutton 1020. Pressing pushbutton 1020 results in P− of unit 1311 and P+ of unit 1321. Fly interface 1214 begins in leading state (+); P− of unit 1311 therefore only causes S− of fly interface 1214. Fly interface 1224 begins in in sync state (0); P+ of unit 1321 therefore causes S+ of fly interface 1224. Entry of the first code thus results in a system formation of (1/0/+) (3/+/−).

Figure 12B:
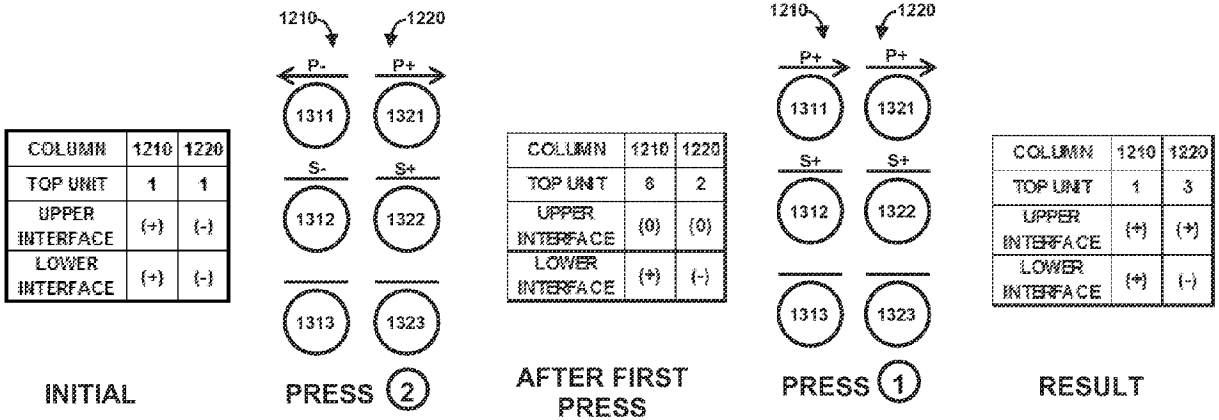
FIG. 12*b* illustrates the operation of the locking system FIG. 11 during entry of a second code.

In FIG. 12*b*, column 1210 begins in home formation (1/+/+), and column 1220 begins in home formation (1/−/−). The code to be entered in FIG. 12*a* is a second code "2-1". The first digit of the first code is entered by pressing pushbutton 1020. Pressing pushbutton 1020 causes P− of unit 1311 and P+ of unit 1312. Fly interface 1214 begins in leading state (+); P− of unit 1311 therefore causes S− of fly interface 1214. Fly interface 1224 begins in lagging state (−); P+ of unit 1321 therefore causes S+ of fly interface 1224. After the first pushbutton press, the system formation is (8/0/+) (2/0/−).

After pushbutton 1020 has been pressed, pushbutton 1010 is pressed. Pressing pushbutton 1010 causes P+ of units 1311, 1321. Fly interface 1214 begins in in sync state (0); P+ of unit 1311 therefore causes S+ of fly interface 1214. Fly interface 1224 begins in in sync state (0); P+ of unit 1321 therefore causes S+ of fly interface 1224. Entry of the second code thus results in a system formation of (1/+/+) (3/+/−). System 1100 is therefore sequence-dependent, as a combination 1-2 is can be differentiated from a combination 2-1. Furthermore, pressing the same button (or entering the same input in other types of user input mechanisms) more than once also changes the column formation. As will be appreciated, this means that system 1100 can allow a user to utilize multiple throws of a single button while still creating a unique code. For example, the system is able to differentiate between a combination of 1-2 versus 1-1-2 or 1-2-2. In the illustrated embodiment, system 1100 is capable of differentiating at least eight consecutive presses of the same button, due to the eight incremental positions of units 300.

Because system 1100 is both sequence-dependent and capable of distinguishing between duplicate entries, the number of unique codes available to the user is greatly increased. By selecting the proper number of columns and rows, codes of any length can be provided for.

Additionally, system 1100 is capable of being recoded without disassembly. An illustrative recoding operation will now be described with reference to FIGS. 1 and 8. The recoding operation begins with resetting columns 200 to the home position by operation of reset mechanism 170. The current code is then entered, such that columns 200 are in the unlocked formation, and cams 400 are vertically movable with respect to fence 500.

The carriage is then lifted by the user, for example by way of a lifting member (not shown) which is coupled to carriage 600 and extends out of housing 192. If the proper code has not been entered, protrusions 522 prevent vertical movement of cams 400, which in turn prevents vertical movement of carriage 600. If the proper code has been entered such that notches 422 are aligned with protrusions 522, carriage 600 is free to be lifted. Lifting carriage 600 moves protrusions 522 into notches 422, and separates each cam 400 from its respective unit 300. The separation distance is greater than the height of protrusions 312, such that protrusions 312 are no longer positioned in recesses 412, and unit 300 is rotatable with respect to cam 400.

Columns 200 are again reset to home formations by operation of reset mechanism 170. Notches 422 remain engaged with protrusions 522, such that cams 400 remain aligned with the protrusions.

Once columns 200 have been reset, a new code is entered, such that columns 200 are moved into a new unlocking formation. Carriage 600 is lowered, protrusions 312 are received in recesses 412, and the system has been recoded. Subsequent entry of the new code (after resetting columns to home formations) causes notches 422 to again become aligned with protrusions 522 such that the system is unlocked.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A lock system comprising:

a fence disposed within a housing and coupled with a user actuated surface useful to move the fence between a locked and unlocked position, the fence including a recess and a protrusion;

a column including a plurality of geared units and a cam, the geared units rotatable about a common axis and disposed adjacent to one another within the housing, the geared units including respective flies that inter-engage with each other at defined arc lengths, the cam translatable along the common axis of the geared units and having a cam surface that can be placed within the recess of the fence to prevent movement of the fence, the cam also having a cam recess that permits the cam to be slid along the protrusion of the fence; and a carriage structured to be slidable within the housing and configured to retain the column and permit selective engagement of the cam with one of the plurality of geared units, the carriage defining a space within which the cam is rotatingly captured, wherein the carriage can be slid from a first position to a second position to disengage the cam from the one of the plurality of geared units when the cam recess is aligned with the protrusion of the fence, and wherein the carriage is prevented from being slid from a first position to a second position such that the cam is engaged with one of the plurality of geared units when the cam surface is placed in the recess of the fence.

2. The lock system of claim 1, which further includes a plurality of cams disposed along the common axis of the units.

3. The lock system of claim 2, wherein each of the plurality of cams includes an engagement surface structured to engage with a neighboring one of the plurality of units which includes a complementary engagement surface to the each of the plurality of cams.

4. The lock system of claim 2, wherein the fence includes parallel disposed prongs, and wherein the parallel disposed prongs each include a recess and a protrusion.

5. The lock system of claim 3, wherein the housing includes user activated buttons, and wherein the interaction of the plurality of cams and plurality of units is structured to provide a multi-pressed button capability to arrange the cams for disengagement.

6. The lock system of claim 1, wherein the cam includes lateral protrusions, and wherein the space defined in the carriage to receive the cams is in the form of a groove.

7. The lock system of claim 1, which further includes a button useful to place the unit and cam in an integer position from among a finite number of integer positions.

8. A system comprising:

a column operable between an unlocked formation and a locked formation;

an interference member which is movable with respect to the column when the column is in the unlocked formation, and which is not movable with respect to the column when the column is in the locked formation;

the column comprising:

a plurality of coaxial unit-cam pairs, each including:

a unit comprising a plurality of radially protruding teeth, each tooth being offset from an adjacent tooth by an increment angle, the unit being incrementally rotatable between a plurality of incremental angular positions with respect to the interference member, each incremental angular position being offset from another of the incremental angular positions by the increment angle;

a cam defining a hollow cylinder having a radial notch formed on an outer circumference thereof, the radial notch being configured to receive a portion of the interference member;

the cam being coaxially associated with the unit;

wherein the unit of each unit-cam pair is selectively engageable with the unit of an adjacent unit-cam pair such that relative rotation between the first and second unit-cam pairs is constrained to a play angle, the play angle being defined as a positive integer multiple of the increment angle, wherein the positive integer is no greater than the number of incremental angular positions of the unit minus two;

wherein each of the unit-cam pairs is operable between a locked position in which the cam prevents movement of the interference member with respect to the column, and an unlocked position in which the notch is aligned with the portion of the interference member which it is configured to receive;

wherein the locked formation is defined as any formation of the column in which any of the unit-cam pairs is in the locked position, and wherein the unlocked formation is defined as a formation in which each unit-cam pair is in the unlocked state, such that the interference member is free to be received in the notches.

9. The system of claim 8, further comprising a reset mechanism configured to adjust the formation of the column to a predetermined home formation.

10. The system of claim 8, wherein the coaxial association is such that the unit-cam pair is operable between a coupled configuration in which the cam and the unit are rotationally coupled and an uncoupled configuration in which the cam and the units are rotatable with respect to one another.

11. The system of claim 9, further comprising a decoupling device operable to adjust each unit-cam pair between the coupled position and the uncoupled position when each unit-cam pair is in the unlocked position.

12. The system of claim 11, wherein the decoupling device is a carriage having a plurality of seats, each configured to receive one of the cams.

13. The system of claim 8, wherein the positive integer is two.

14. The system of claim 8, wherein each unit further comprises a first arcuate protrusion formed an a first axial end of the unit, and a second arcuate protrusion on the opposing axial end of the unit;

wherein the first arcuate protrusion is defined by a first central angle, the second arcuate protrusion is defined by a second central angle, and wherein the sum of the first central angle, the second central angle, and the play angle is equal to 360°.

15. The system of claim 14, wherein interaction between the first arcuate protrusion of a first of the plurality of unit-cam pairs and the second arcuate protrusion of a second of the plurality of unit-cam pairs provides the first and second unit-cam pairs with the selective engageability.

16. The system of claim 8, wherein the interference member is a fence comprising:

a plurality of protrusions, each protrusion configured to be received in the notch of one of the cams;

a plurality of recesses, each recess configured to receive one of the cams;

wherein the fence is configured such that, in the unlocked formation of the column, each protrusion is aligned with one of the notches such that the fence is movable in an axial direction of the column, and in the locked state, at least one of the cams is positioned in one of the recesses such that the fence is not movable in an axial direction of the column.

17. The system of claim 8, further comprising a plurality of the columns, wherein the interference member is movable with respect to the plurality of columns when each of the plurality of columns is in an unlocked formation and is not movable with respect to the plurality of columns when at least one of the plurality of columns is in a locked formation.

18. The system of claim 17, further comprising a first unit-rotating mechanism configured to incrementally rotate a first of the units in a first direction in response to a first input.

19. The system of claim 18, wherein the first unit is located in a first of the columns;

the first unit-rotating mechanism being further configured to incrementally rotate a second of the units in the first direction in response to the first input, the second unit being located in a second of the columns.

20. The system of claim 19, further comprising a second unit-rotating mechanism configured to incrementally rotate the first unit in a second direction opposite the first direction in response to a second input.

21. The system of claim 20, wherein the second unit-rotating mechanism is further configured to incrementally rotate the second unit in the first direction in response to the second input.

22. The system of claim 21, wherein the first unit-rotating mechanism is a first pushbutton having a first leg operable to rotate the first unit in the first direction and a second leg operable to rotate the second unit in the first direction.

23. The system of claim 22, where the second unit-rotating mechanism is a second pushbutton having a third leg operable to rotate the first unit in the second direction and a fourth leg operable to rotate the second unit in the first direction.

24. The system of claim 21, wherein the positive integer is two.

25. The lock system of claim 2, which further includes a plurality of columns.

* * * * *